US010125437B2

(12) United States Patent
Kim et al.

(10) Patent No.: US 10,125,437 B2
(45) Date of Patent: Nov. 13, 2018

(54) POLYESTER ARTIFICIAL HAIR AND METHOD OF PREPARING THE SAME

(71) Applicant: UNO & COMPANY LTD., Wanju-gun (KR)

(72) Inventors: Jong Chun Kim, Jeonju-si (KR); Sung Min Oh, Jeonju-si (KR); Chan Young Kim, Jeonju-si (KR); Sung Hyun Lee, Jeonju-si (KR)

(73) Assignee: UNO & COMPANY LTD., Wanju-Gun, Jeollabuk-Do (KR)

( * ) Notice: Subject to any disclaimer, the term of this patent is extended or adjusted under 35 U.S.C. 154(b) by 247 days.

(21) Appl. No.: 15/182,556

(22) Filed: Jun. 14, 2016

(65) Prior Publication Data

US 2017/0356103 A1 Dec. 14, 2017

(51) Int. Cl.

| | |
|---|---|
| ***D01F 6/84*** | (2006.01) |
| ***A41G 3/00*** | (2006.01) |
| ***D01F 1/07*** | (2006.01) |
| ***D01F 6/92*** | (2006.01) |

(52) U.S. Cl.

CPC ..... *D01F 6/84* (2013.01); *A41G 3/0083* (2013.01); *D01F 1/07* (2013.01); *D01F 6/92* (2013.01)

(58) Field of Classification Search

CPC ..... D01F 6/84; D01F 1/07; D01F 6/92; A41G 3/0083

USPC ..... 524/410

See application file for complete search history.

(56) References Cited

U.S. PATENT DOCUMENTS

| | | | | |
|---|---|---|---|---|
| 7,759,429 | B2 | 7/2010 | Kowaki et al. | |
| 7,759,430 | B2 | 7/2010 | Kowaki et al. | |
| 8,211,542 | B2 | 7/2012 | Masuda et al. | |
| 9,267,221 | B2 | 2/2016 | Kim et al. | |
| 2009/0260646 | A1* | 10/2009 | Masuda | A41G 3/0083 132/53 |
| 2010/0311920 | A1* | 12/2010 | Gonzalez Montiel | C08F 222/00 525/92 E |

* cited by examiner

*Primary Examiner* — Ling Siu Choi
*Assistant Examiner* — Ronald Grinsted
(74) *Attorney, Agent, or Firm* — Joseph G. Chu; JCIP

(57) ABSTRACT

A flame-retardant polyester artificial hair filaments according to the present invention comprises: (A) 100 parts by weight of a thermoplastic polyester resin; (B) 10-20 parts by weight of a polymeric brominated polystyrene flame retardant; (B) 5-10 parts by weight of a polymeric phosphorus flame retardant; (D) 0.1-3 parts by weight of a chain extender; and (E) 0.5-3 parts by weight of sodium antimonate.

7 Claims, No Drawings

POLYESTER ARTIFICIAL HAIR AND METHOD OF PREPARING THE SAME

FIELD

The present invention relates to polyester filaments for artificial hair. More particularly, the present invention relates to polyester filaments for artificial hair, which contains a thermoplastic polyester resin or copolymerized polyester resin as a base resin, and a polymeric brominated polystyrene flame retardant and a polymeric phosphorus flame retardant as flame retardant, artificial hair made from the filaments, and a method for preparing the filaments.

BACKGROUND

Artificial hair that is used as filaments for wigs is required to have flame retardancy and heat resistance in addition to a clear color, natural gloss, lightweight, heat resistance, a soft touch feeling, flexibility, and the abilities to form and retain curls. As used herein, the term "flame retardancy" is defined as a self extinguishing property and the anti-dripping property of molten polymers. The term "heat resistance" refers to the property of hair to resist the temperature at which curls can be formed by a hair iron, without being shrunk or deformed by thermal stress. Heat resistance and flame retardancy are the most important properties required for artificial hair filaments that perform the function of human hair.

In the prior art, PVC filaments or modacrylic filaments have been used as filaments for wigs. These filaments have very excellent flame retardancy, but have the disadvantage of insufficient heat resistance because of their low softening temperature, and for this reason, the use thereof in applications requiring heat resistance is limited.

To overcome this disadvantage, polyester artificial hair based on a resin having a relatively high heat distortion temperature is used. Examples of the resin that is used for polyester artificial hair include polyethylene terephthalate (PET), polybutylene terephthalate (PBT), polypropylene terephthalate (PPT), polycyclohexanedimethanol terephthalate (PCT), polynaphthalene terephthalate (PEN), etc. These polyester resins have a relatively high heat resistance, but are flammable resins that are easily burned and have the property of dripping high-temperature molten polymer drops upon contact with flames. Thus, in order to use these resins as artificial hair, flame retardancy needs to be imparted to these resins. Artificial hair has a thickness of 40-100 denier (corresponding to 40-100 μm), which is thicker than that of filaments for clothes. Because artificial hair is connected to the scalp or hair of a person who wears a wig, a high degree of flame retardancy needs to be imparted to the artificial hair in order to protect the wig-wearing person from a burn upon contact with flames.

A number of technologies for imparting flame retardancy to flammable thermoplastic polyester resins to use the resins as artificial hair are known.

Polyester resins are flammable, easily catch fire and are rapidly burned while dripping high-temperature molten polymer drops.

In the prior art, an attempt was made to use a copolymer resin synthesized by adding phosphorus (P) atoms during a polyester preparation process, but it was difficult for phosphorus atoms to provide sufficient flame retardancy to the resin for use as artificial hair. For this reason, a number of artificial hairs containing a polymeric brominated flame retardant are known.

U.S. Pat. Nos. 7,759,429, 7,759,430, and 8,211,542 disclose a flame retardant polyester artificial hair containing a brominated epoxy flame retardant. However, the brominated flame retardant used in these patents has a shortcoming in that it has artificial hair becomes heavy due to the high specific gravity of the flame retardant, and thus has poor wear feeling. In addition, there is a problem in that bromine gas harmful to workers is generated in a process of compounding the polyester resin with the brominated flame retardant and a high-temperature melt spinning process. Further, workers can also be exposed to bromine gas in a process of drawing or heat-treating undrawn yarns. In a wig making process, workers are exposed to the same harmful gas when forming curls at a temperature of 100~130° C. for a long period of time. The biggest problem is that when the wig product is disposed of by incineration, large amounts of bromine compounds are discharged in a gaseous state to cause atmospheric pollution. For this reason, there is also a problem in that polymer fragments that are generated in a process of making frame-retardant polyester artificial hair are disposed of as waste without being recycled. Moreover, a wig made of polyester artificial hair containing the brominated flame retardant can be harmful to a person who wears it, because it is used in close contact with the scalp of the person. Thus, there is a need for new flame-retardant polyester artificial hair containing no brominated flame retardant. Conventional processes for producing flame-retardant polyester artificial filaments include a process of compounding raw materials, a melt spinning process, a drawing process and a heat treatment process. In the melt spinning process, a plurality of molten filaments are discharged through a plate nozzle below a die mounted at the front end of an extruder to form a filaments. The barrel temperature of the extruder is 250~280° C., and the temperature of the die and the nozzle portion is 280~290° C. However, if the polyester filaments containing the polymeric phosphorus flame retardant is used in a system for making polyester artificial hair containing a conventional brominated flame retardant, the following problems will arise.

The glass transition temperature (Tg) of the polymeric phosphorus-based flame retardant used is lower than that of the conventional brominated flame retardant by 40~50° C., and the flow rate of the molten polymer at the temperature of the die and the nozzle is very high. Further, if the polymeric phosphorus-based flame retardant is added in an amount of 10-30 parts by weight based on 100 parts by weight of the polyester resin, the polyester resin will contain a large amount of phosphorus (P) which reduces the melt viscosity of the polyester resin.

As a result, when phosphorus-based artificial hair having a thickness of 40-80 denier is to be produced, the discharge of the polymer from the lower portion of the nozzle in the melt spinning process will not be uniform, and the melt tension of the molten polymer will be reduced, making it impossible to wind undrawn yarns having a specific thickness. Further, filament breakage will occur during melt spinning, making it impossible to continuously prepare undrawn yarns, and a filaments obtained by drawing and heat-treating prepared drawn yarns will have low strength and elongation, and thus cannot be used as artificial hair.

The present inventor has developed a flame retardant polyester filaments for a artificial hair, which comprises: (A) 100 parts by weight of a thermoplastic polyester resin; (B) 10-30 parts by weight of a polymeric phosphorus-based flame retardant; (C) 0.1-3 parts by weight of a chain extender; and (D) 0.5-3 parts by weight of sodium antimonite, and obtained a patent for the filaments as U.S. Pat. No.

9,267,221. However, the US Patent has a disadvantage that whitening occurs during the process of setting the artificial hair with saturated water vapor. The whitening means that the gloss of the surface of artificial hair is changed to white. For forming good curl, artificial hair shall be treated with saturated water vapor or in a dry box. However, the US Patent has a disadvantage that whitening occurs during the treatment with saturated water vapor.

The present inventors have developed an advanced artificial hair which does not cause whitening during the treatment of the artificial hair with saturated water vapor.

Objects of the Invention

It is an object of the present invention to provide a novel polyester artificial hair filaments, which is prepared by melt-spinning a composition comprising a mixture of a polyester resin and a polymeric phosphorus flame retardant and has a strength and elongation suitable for use as artificial hair.

Another object of the present invention is to provide polyester artificial hair filaments, which provides artificial hair having no broken filament and comprising uniform filaments.

Still another object of the present invention is to provide polyester artificial hair filaments which have excellent flame retardancy and drip resistance even when containing a small amount of a flame retardant.

Still another object of the present invention is to provide polyester artificial hair filaments which have high gloss, a clear color, good curl formability, lightweight, physical properties similar to those of human hair, and excellent fundamental properties required for wig filaments.

Still another object of the present invention is to provide novel artificial hair filaments which does not cause whitening during the treatment of the artificial hair with saturated water vapor.

The above and other objects of the present invention can all be accomplished by the present invention as described in detail below.

SUMMARY OF THE INVENTION

A flame-retardant polyester artificial hair filaments according to the present invention comprises: (A) 100 parts by weight of a thermoplastic polyester resin; (B) 10-20 parts by weight of a polymeric brominated polystyrene flame retardant; (C) 5-10 parts by polymeric phosphorus flame retardant; (D) 0.1-3 parts by weight of a chain extender; and (E) 0.5-3 parts by weight of sodium antimonate.

The polyester resin (A) may preferably be at least one selected from among polyethylene terephthalate (PET), polybutylene terephthalate (PBT), polypropylene terephthalate (PPT), polycyclohexanedimethanol terephthalate (PCT), polynaphthalene terephthalate (PEN), etc.

The polymeric brominated polystyrene flame retardant (B) may preferably be a flame retardant having a repeat unit of the following Formula 1 or Formula 2 and a weight average molecular weight of about 60,000. The flame retardant of Formula 1 and Formula 2 has excellent compatibility with the thermoplastic polyester resin, and has Tg of about 140~160° C.

Formula 1

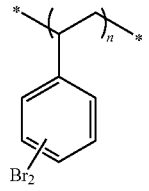

Formula 2

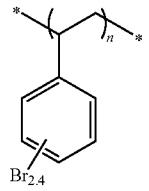

where n is an integer.

The polymeric phosphorus flame retardant (C) may preferably be a flame retardant having a repeat unit of the following Formula 3 and a weight-average molecular weight ranging from 80,000 to 150,000:

Formula 3

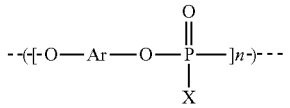

wherein Ar is an aromatic group, X is a $C_{1-20}$ alkyl, a $C_{2-20}$ alkene, a $C_{2-20}$ alkine, a $C_{5-20}$ cycloalkyl, or a $C_{6-20}$ aryl, and n is an integer ranging from 1 to 100.

The chain extender (D) is a compound of the following Formula 4, which contains an epoxy group and comprises a copolymer based on styrene, acrylate or methacrylate. This compound has two or more epoxy groups in the molecule:

Formula 4

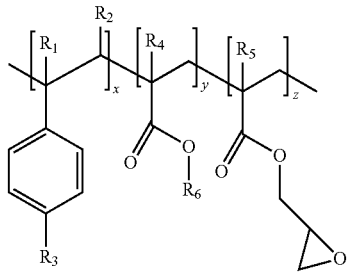

wherein $R_1$ to $R_5$ are each hydrogen or an alkyl group, $R_6$ is an alkyl group, and x, y and z are each an integer ranging from 1 to 20.

The sodium antimonate (E) is a compound having an average particle diameter of 0.1-1.0 μm and is represented by the following Formula 5:

$$Na_2SbO_3.nH_2O \quad \text{Formula 5}$$

The flame-retardant polyester artificial hair filaments according to the present invention may further include conventional additives, including an inorganic quencher, a thermal stabilizer, a light stabilizer, a UV stabilizer, a fluorescent agent, an antioxidant, an antistatic agent, a pigment, a dye, a plasticizer, a lubricant, a flame retardant, a flame retardant aid, an inorganic filler agent, etc.

The flame-retardant polyester artificial hair filaments according to the present invention preferably have a fineness of 40-100 denier. The artificial hair filaments are used to make a wig.

The flame-retardant polyester artificial hair filaments according to the present invention is prepared by a method comprising the steps of: extruding a composition comprising a mixture of a polyester resin, a polymeric brominated polystyrene flame retardant, a polymeric phosphorus flame retardant, a chain extender and sodium antimonate to form a pellet; drying the pellet to a water content of 500 ppm or less; melt-spinning the dried pellet to prepare a undrawn yarn; drawing the undrawn yarn at a draw ratio of 2-5; and heat-treating the drawn yarn in a heat treatment device heated to a temperature of 150~280° C.

DETAILED DESCRIPTION OF THE PREFERRED EMBODIMENTS

The present invention relates to a polyester filaments for artificial hair, and more particularly to a polyester artificial hair filaments containing a polyester resin and a polymeric brominated polystyrene flame retardant and a polymeric phosphorus flame retardant.

A flame-retardant polyester artificial hair filaments according to the present invention comprises: (A) 100 parts by weight of a thermoplastic polyester filaments; (B) 10-20 parts by weight of a polymeric brominated polystyrene flame retardant; (C) 5-10 parts by weight of a polymeric phosphorus flame retardant; (D) 0.1-3 parts by weight of a chain extender; (E) 0.5-3 parts by weight of sodium antimonate; and (F) a small amount of a conventional additive. Each of the components of the flame-retardant polyester artificial hair filaments will now be described in detail.

(A) Polyester Resin

In the present invention, a polyester resin is used as a base resin. Preferred examples of the resin include polyethylene terephthalate (PET), polybutylene terephthalate (PBT), polypropylene terephthalate (PPT), polycyclohexanedimethanol terephthalate (PCT), polynaphthalene terephthalate (PEN), etc., which may be used alone or in the form of mixtures or copolymers of two more thereof. These resins may be commercial products that are easily commercially available.

(B) Polymeric Brominated Polystyrene Flame Retardant

The polymeric brominated polystyrene flame retardant (B) may preferably be a flame retardant having a repeat unit of the above Formula 1 or Formula 2 and a weight-average molecular weight of about 60,000. The flame retardant of Formula 1 or Formula 2 has an excellent compatibility with a thermoplastic polyester resin, and has $T_g$ of about 140~160° C. Preferred examples of the flame retardant include polydibromostyrene (PDBD-80 and PBS-64HW) of Great Lakes Co. The flame retardant is a homopolymer of dibromostyrene having a weight-average molecular weight of about 60,000. This flame retardant is preferably used in an amount of 10-20 parts by weight based on 100 parts by weight of the polyester resin. If the flame retardant is used in an amount of less than 10 parts by weight, a sufficient flame retardancy for artificial hair will not be ensured, and if the flame retardant is used in an amount of more than 20 parts by weight, the flame retardant will have a disadvantage in color adjustment of an artificial hair as it has light yellow color in itself Formula 1

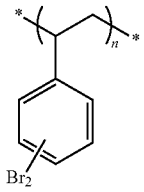

Formula 2

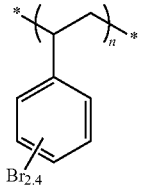

where n is an integer.

The polymeric brominated polystyrene flame retardant that is used in the present disclosure may suitably be SAYTEX HP-3010, SAYTEX HP-5010, SAYTEX HP-7010 and Pyrocheck 68PB (products of Albermarle Co.). However, the temperature condition of the extruder in the melt spinning process needs to be modified because the above flame retardant has a high content of brome and $T_g$ of the flame retardant is higher than that of Formula 1 and Formula 2 by 20~50° C.

(C) Polymeric Phosphorus Flame Retardant

The polymeric phosphorus-based flame retardant (C) that is used in the present invention may preferably be a flame retardant having a repeat unit of the following Formula 3 and a weight-average molecular weight ranging from 80,000 to 150,000:

Formula 3

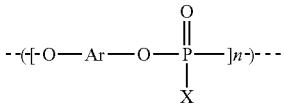

wherein Ar is an aromatic group, X is a $C_{1-20}$alkyl, a $C_{2-20}$ alkene, a $C_{2-20}$ alkine, a $C_{5-20}$ cycloalkyl, or a $C_{6-20}$ aryl, and n is an integer ranging from 1 to 100.

The phosphorus-based flame retardant is a polymeric phosphorus-based flame retardant containing polyphosphonate. Specifically, it is a polyphosphonate flame retardant prepared by polymerizing diaryl alkyl phosphonate, diaryl awl phosphonate, or a combination thereof, with dihydric phenols, bisphenols, or a combination thereof, which are aromatic dihydroxy compounds.

This flame retardant is used in an amount of 5-10 parts by weight based on 100 parts by weight of the polyester resin. If the flame retardant is used in an amount of less than 5 parts by weight, sufficient flame retardancy for artificial hair and drip resistance upon melting will not be ensured, and if the flame retardant is used in an amount of more than 10 parts by weight, the flow rate of the molten polymer composition will be too high, making melt spinning impossible.

(D) Chain Extender

The chain extender (D) is a compound of the following Formula 4, which contains an epoxy group and comprises a copolymer based on styrene, acrylate or methacrylate. This compound has two or more epoxy groups in the molecule.

Formula 4

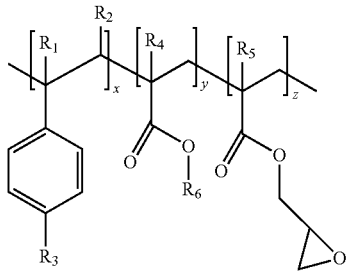

wherein $R_1$ to $R_5$ are each hydrogen or an alkyl group, $R_6$ is an alkyl group, and x, y and z are each an integer ranging from 1 to 20.

The chain extender should be used in such an amount that the melt tension of the molten polymer in a melt spinning process can be maintained at a suitable level. The chain extender is used in an amount of 0.1-3 parts by weight, and preferably 0.3-1.3 parts by weight, based on 100 parts by weight of the sum of the polyester resin and the phosphorus-based flame retardant. If the chain extender is used in an amount of less than 0.1 parts by weight, the melt tension of the molten polymer will be insufficient, and if the chain extender is used in an amount of 3 parts by weight, the melt tension of the molten polymer will excessively increase, and thus the discharge of the molten polymer from fine nozzle holes will decrease.

In the present invention, a chain stabilizer may additionally be used to improve the extrusion stability of molten polymer strands. The chain stabilizer is an acrylic copolymer having an epoxy reactive group, for example, glycidyl acrylate, glycidyl methacrylate or the like. In addition, it may also be a copolymer of a monomer having an epoxy reactive group with an acrylic monomer having no epoxy reactive group. Examples of the acrylic monomer having no epoxy reactive group include alkyl methacrylate, alkyl am/late, styrene derivatives, etc. Specifically, the chain stabilizer that is used in the present invention may be a low-molecular-weight styrene-acrylate copolymer having 3-9 glycidyl reactive groups.

(E) Sodium Antimonate

The sodium antimonate (E) is a compound having an average particle diameter of 0.1-1.0 μm and represented by the following Formula 5:

$$Na_2SbO_3.nH_2O \qquad \text{Formula 5}$$

The sodium antimonate together with the chain extender in the present invention has the effect of reducing the flow rate of the molten polymer that is discharged from nozzles in a high-temperature melt spinning process. Particularly, the sodium antimonate can exhibit a synergistic effect with a chain extender composed of a styrene-acrylate copolymer having an epoxy reactive group as described in the present invention.

The sodium antimonate has a light transparency higher than antimony trioxide ($Sb_2O_3$) used in the prior art, and thus is suitable for use in flame-retardant polyester artificial hair requiring transparency.

The sodium antimonate is used in an amount of 0.1-5 parts by weight, and preferably 0.5-3 parts by weight, based on 100 parts by weight of the polyester resin. If the sodium antimonate is used in an amount of less than 0.1 parts by weight, it will have an insignificant effect on the stabilization of the flow rate of the molten polymer, and if the sodium antimonate is used in an amount of more than 5 parts by weight, it will make the color of colored artificial hair turbid, making it difficult to obtain artificial hair having a clear color. In addition, the generation of single yarns in spinning and drawing processes will increase, surface protrusions will occur, and the entanglement of the resulting filaments upon combing will increase, suggesting that the resulting filaments is not suitable for use as artificial hair filaments.

(F) Other Additives

In addition to the above-described components, the artificial hair filaments according to present invention may, if necessary, further comprise conventional additives, including an inorganic quencher, a thermal stabilizer, a light stabilizer, a UV stabilizer, a fluorescent agent, an antioxidant, an antistatic agent, a pigment, a dye, a plasticizer, a lubricant, a flame retardant, a flame retardant aid, an inorganic filler, etc. These additives may be used along or in a mixture of two or more.

The flame-retardant polyester artificial hair filaments according to the present invention preferably have a fineness of 40-100 denier. The artificial hair filaments are used to make a wig.

The flame-retardant polyester artificial hair filaments according to the present invention is prepared by a method comprising the steps of: extruding a composition comprising a mixture of a polyester resin, a polymeric brominated polystyrene flame retardant, a polymeric phosphorus flame retardant, a chain extender and sodium antimonate to form a pellet; drying the pellets to a water content of 500 ppm or less; melt-spinning the dried pellet to prepare a undrawn yarn; drawing the undrawn yarn at a draw ratio of 2-5; and heat-treating the drawn yarn in a heat treatment device heated to a temperature of 150~280° C.

Because the polyester resin that is used as a base resin in the present invention has high melt flow rate, it is preferably sufficiently dried to remove water before mixing with the flame retardant or before melt spinning.

Preferably, a drying step may further be performed before the step of extruding the composition to form pellets. The king step is generally performed in a nitrogen atmosphere at a temperature of 80~180° C. for 3-10 hours. Preferably, the king step is performed at a temperature of 95~150° C. for 4-8 hours. The water content of the composition after the drying step is 500 ppm or lower, and preferably 0-100 ppm. If the composition is not sufficiently dried, the number of spinning failures in a spinning process can increase.

The dried composition is extruded according to a conventional method to form pellets. The extrusion is preferably performed using a twin screw extruder.

The extruded pellets can be melt-spun according to a conventional method. In one embodiment, the composition is extruded through an extruder having a nozzle mounted at the front end, thereby preparing undrawn yarns. The shape of a spinneret that is used in the melt spinning process is not specifically limited and is, for example, a peanut shape, a star shape, an oval shape, a hollow oval shape or the like. The spinning temperature that is the temperature of the extruder cylinder is 200~280° C.

The undrawn yarns are drawn at a draw ratio of 2-5 in a drawing machine. The drawing machine that is used in the present invention may be a conventional heating drum drawing machine, but is not limited thereto.

The drawn yarns are heat-treated in a heat treatment device heated to a temperature of 150~280° C. The heat-treatment process and the heat-treatment device can be easily carried out by those skilled in the art to which the present invention pertains.

The flame-retardant polyester artificial hair filaments according to the present invention are not substantially deformed even by a hair iron at 120~200° C., and thus has excellent heat resistance. In addition, it has a very high flame retardancy, does not substantially drip, has gloss similar to that of human hair, and also has a clear color. Thus, it is very suitable for use as a wig. In addition, the artificial hair filaments do not cause whitening during the treatment of the artificial hair with saturated water vapor.

The present invention will be better understood with reference to the following examples, which are for illustrative purposes and are not intended to limit the scope of the present invention as defined in the appended claims.

Examples

The specifications of the components used in each of Examples 1 to 3 and Comparative Examples 1 to 3 are as follows.

(A) Polyester resins:

Co-polyester PCTA 13319® having an inherent viscosity of 0.96 and density of 1.195 and PCT® A-150 having an inherent viscosity of 0.77 (Eastman Chemical Co.).

(B) Polymeric Brominated Polystyrene Flame Retardant PDBS-80® having a weight-average molecular weight 6000 g/mol and PBS 64 HW (Great Lakes Co.).

(C) Polymeric phosphorus flame retardant:

Nofia® HM1100 (FRX Polymers Inc.) having a number-average molecular weight 80000~120000 g/mol.

(D) Chain extender: Joncryl® ADR4370 (BASF).

(E) Sodium antimonate: SA-A® (Nippon Seiko Co. Ltd.).

The above-described components were mixed with each other in the amounts shown in Table 1 below. The mixture was dried under a nitrogen atmosphere at 130° C. for 6 hours, and then extruded through a twin screw compounder to prepare pellets. The pellets were dried to a water content of 500 ppm or lower under a nitrogen atmosphere at 130° C. for 6 hours immediately before spinning, after which the dried pellets were placed in an extruder having a 160-hole nozzle attached to the front end and were melt-spun to prepare a 200-denier undrawn yarn. The spinning temperature that was the temperature of the extruder cylinder was 250~280° C. The undrawn yarn was drawn 3.5 times in a heating drum drawing machine to prepare a drawn yarn. The drawn yarn was heat-treated in a heat-treatment device heated to 250° C., thereby preparing artificial hair filaments having a fineness of 50 denier.

In Examples 1 to 3 and Comparative Examples 1 and 3 as shown in Table 1 below, the contents of the chain extender and the sodium antimonate were maintained at constant levels, and the contents of the brominated polyester flame retardant and the phosphorus-based flame retardant were changed.

Physical properties were measured in the following manner, and the results of the measurement are shown in Table 1 below.

Strength and elongation: Artificial hair composed of a filament bundle (320 strands) was cut to a length of 90 cm, and the actual thickness (De) of the cut filaments was calculated and the strength and elongation thereof were measured five times by a pull-to-break test using a universal testing machine (UTM; load cell: 100 kgf; initial load: 0.5 kgf; speed: 200 mm/min; length: 20 mm).

Flame retardancy: A filament bundle (160 strands) was cut to a length of 15 cm. The cut filaments were brought into contact with a 2-cm flame for 5 seconds, and then the time taken for the flame to be extinguished was measured. Evaluation was performed according to the following criteria: ◎: flame extinguishing time shorter than 1 second, ○: flame extinguishing time shorter than 3 seconds, Δ: flame extinguishing time shorter than 5 seconds, and x: flame extinguishing time longer than 6 seconds.

Melt drip property: A filaments bundle was brought into contact with flame, and the dripping of the molten resin when catching fire was measured. The drip property was determined by measuring the number of molten resin drips. Specifically, a filaments bundle (160 strands) was drooped vertically and brought into contact with a 30-mm flame, and the number of drips from the filaments was measured while 100 mm of the filaments was burned. Evaluation was performed according to the following criteria ◎: drip number of 0, ○: drip number of 1-2, Δ: drip number of 3-4, and x: drip number larger than 4.

Heat resistance: 10 drawn yarns (160 strands) were bundled, and the yarn bundle was inserted into a specifically manufactured domestic electric hair iron heated to 230° C. and was heated for 10 seconds. Then, the deformation of the filaments by shrinkage, the deformation by thermal stress and the like were visually observed. The absence of deformation after heat treatment was judged as good heat resistance, and the presence of deformation after heat treatment was judged as poor heat resistance. Evaluation was performed according to the following criteria: ◎: no deformation, ○: slight shrinkage that did not damage the appearance, Δ: shrinkage that did damage the appearance, x: occurrence of shrinkage and melting.

Gloss: Artificial filaments composed of a 80,000-denier filament bundle (160 holes×50 denier×10 strands) was cut to a length of 10 cm, and the gloss of the cut filaments was visually observed under sunlight. Evaluation was performed according to the following criteria: ◎: gloss similar to that of human hair, ○: gloss higher than that of human hair, Δ: gloss lower than that of human hair, and x: dull gloss lower than that of human hair.

Gloss before and after of steam treatment: An artificial hair was set for curl under 120° C. steam condition with 100% relative humidity for 60 minutes to evaluate any change in gloss and color. The artificial hair sample was cut to a length of 30 cm each and sewed to be sample for curl set. The sample was first put down on natural pulp paper and then winded up to a 30 mm diameter aluminum pipe with steady pressure finally fixed to the pipe with a rubber band. The sample was put into a steam box with steam temperature 120° C., relative humidity 100% for 60 minutes to go through heat treatment. After the above heat treatment has been finished, the sample was taken out to cool in room temperature for one hour to evaluate the change in actual transparency. Evaluation was performed according to the following criteria ◎: gloss, color no change, ○: no change gloss, some change in color, Δ: some change in both gloss and color, and x: severe change.

Color: Artificial filaments composed of a 80,000-denier filament bundle (160 holes×50 denier×10 strands) was cut to a length of 10 cm, and the color of the cut filaments was visually observed under sunlight. The color clearness was evaluated according to the following four criteria: ◎: most clear, ○: clear, Δ: slightly not clear, and x: turbid.

Processability: The number of spinning failures for 5 hours in a spinning process was measured. Evaluation was performed according to the following criteria: ◎: spinning failure number of 0, ○: spinning failure number of 1, Δ: spinning failure number of 2-3, and x: spinning failure number of 4 or more and impossible spinning.

TABLE 1

| | Ex. 1 | Ex. 2 | Ex. 3 | Comp. Ex. 1 | Comp. Ex. 2 | Comp Ex. 3 |
|---|---|---|---|---|---|---|
| (A) Thermoplastic Polyester | | | | | | |
| * A-1 PCTA 13319 | 100 | 100 | — | 100 | 100 | 100 |
| * A-2 PCT 150 | — | — | 100 | — | — | — |
| (B) Polymeric Brominated Polystyrene Flame Retardant | | | | | | |
| * B-1 PDBS-80 | 16 | — | 15 | 23 | — | — |
| * B-2 PBS-64HW | — | 14 | — | — | 22 | — |
| (C) Polymeric Phosphorus Flame Retardant | | | | | | |
| * HM-1100 | 5 | 7 | 5 | — | — | 20 |
| (D) Chain Extender | | | | | | |
| * Joncryl ADR 4370 | 1.0 | 1.0 | 1.0 | 1.0 | 1.0 | 1.0 |
| (E) Sodium Antimonate | | | | | | |
| * SA-A | 0.8 | 0.8 | 0.8 | 0.8 | 0.8 | 0.8 |
| Strength | 2.0 | 1.9 | 1.7 | 2.3 | 2.2 | 1.8 |
| Elongation | 95 | 105 | 87 | 85 | 90 | 95 |
| Flame Retardancy | ◎ | ◎ | ◎ | ◎ | ◎ | ◎ |
| Anti-dripping | ◎ | ◎ | ◎ | ◎ | ◎ | ◎ |
| Heat Resistance | ◎ | ◎ | ◎ | ◎ | ◎ | ○ |
| Curling | ○ | ○ | ○ | Δ | Δ | ○ |
| Color | ◎ | ◎ | ◎ | Δ | Δ | ○ |
| Gloss of Before treatment | ○ | ○ | ○ | Δ | Δ | Δ |
| Gloss of After treatment | ○ | ○ | ○ | Δ | Δ | X |
| Processability | ◎ | ◎ | ◎ | Δ | Δ | Δ |

Simple modification to change of the present invention can be easily implemented by those of ordinary skill in the art, it can be seen to be included in the scope of the invention all such modification and changes.

The invention claimed is:

1. A flame-retardant polyester artificial hair filaments, which comprises:

(A) 100 parts by weight of a thermoplastic polyester resin;

(B) 10-20 parts by weight of a polymeric brominated polystyrene flame retardant;

(C) 5-10 parts by weight of a polymeric phosphorus flame retardant;

(D) 0.1-3 parts by weight of a chain extender; and (E) 0.5-3 parts by weight of sodium antimonate;

wherein said polyester resin (A) is selected from the group consisting of polyethylene terephthalate (PET), polybutylene terephthalate (PBT), polypropylene terephthalate (PPT), polycylohexanedimethanol terephthalate (PCT), and polynapthalene terephthalate (PEN), and wherein said polymeric brominated polystyrene flame retardant (B) is a flame retardant having a repeat unit of the following Formula 1 or Formula 2 and a weight-average molecular weight about 60,000, Formula 1

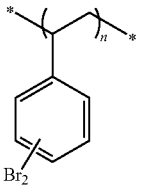

-continued

Formula 2

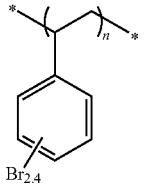

where n is an integer.

2. The flame-retardant polyester artificial hair filaments of claim 1 in which said polymeric phosphorus flame retardant (C) is a flame retardant having a repeat unit of the following Formula 3 and a weight-average molecular weight ranging from 80,000 to 150,000:

Formula 3

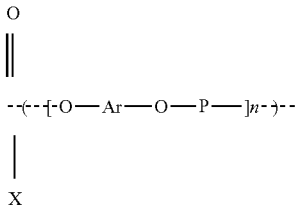

wherein Ar is an aromatic group, X is a $C_{1-20}$ alkyl, a $C_{2-20}$ alkene, a $C_{2-20}$ alkyne, a $C_{5-20}$ cycloalkyl, or a $C_{6-20}$ aryl, and n is an integer from 1 to 100.

3. The flame-retardant polyester artificial hair filaments of claim 1 in which said chain extender (D) is a compound of Formula 4, which contains an epoxy group and comprises a copolymer based on styrene, acrylate or methacrylate:

Formula 4

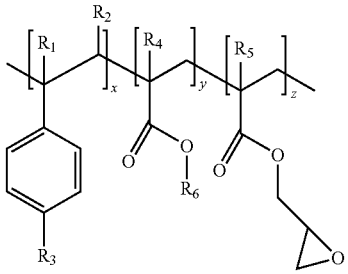

wherein $R_1$ to $R_5$ are each hydrogen or an alkyl group, $R_6$ is an alkyl group, and x, y and z are each an integer ranging from 1 to 20.

4. The flame-retardant polyester artificial hair filaments of claim 1 in which said sodium antimonate (E) is a compound having an average particle diameter of 0.1-1.0 μm and is represented by Formula 5:

$$Na_2SbO_3.nH_2O \quad \text{Formula 5}$$

5. The flame-retardant polyester artificial hair filaments of claim 1, which further comprises an inorganic quencher, a thermal stabilizer, a light stabilizer, a UV stabilizer, a fluorescent agent, an antioxidant, an antistatic agent, a pigment, a dye, a plasticizer, a lubricant, a flame retardant, a flame retardant aid, and/or an inorganic filler.

6. The flame-retardant polyester artificial hair filaments of claim 1, which has a fineness of 40-100 denier.

7. A wig prepared with the flame-retardant polyester artificial hair filaments of any one claim of 1, 2, 3, 4, 5, or 6.

* * * * *